US011066272B2

(12) United States Patent
Sharpe et al.

(10) Patent No.: US 11,066,272 B2
(45) Date of Patent: Jul. 20, 2021

(54) CABLE STORAGE AND HANDLING SYSTEMS AND METHODS

(71) Applicant: Rolls-Royce Canada Limited, Lachine (CA)

(72) Inventors: Terry Sharpe, Peterborough (CA); Bob Millett, Millbrook (CA); Graham Knowles, Peterborough (CA)

(73) Assignee: ROLLS-ROYCE CANADA LIMITED, Lachine (CA)

( * ) Notice: Subject to any disclaimer, the term of this patent is extended or adjusted under 35 U.S.C. 154(b) by 167 days.

(21) Appl. No.: 16/392,049

(22) Filed: Apr. 23, 2019

(65) Prior Publication Data

US 2020/0339376 A1 Oct. 29, 2020

(51) Int. Cl.

| | |
|---|---|
| ***B65H 57/24*** | (2006.01) |
| ***B65H 57/12*** | (2006.01) |
| ***B65H 57/10*** | (2006.01) |
| ***B65H 57/04*** | (2006.01) |

(52) U.S. Cl.

CPC ..... *B65H 57/24* (2013.01); *B65H 57/04* (2013.01); *B65H 57/10* (2013.01); *B65H 57/12* (2013.01); *B65H 2401/15* (2013.01)

(58) Field of Classification Search

CPC ..... B65H 57/006; B65H 57/10; B65H 57/12; B65H 57/24; B65H 75/4407; B65H 57/28

USPC ..... 242/615.3

See application file for complete search history.

(56) References Cited

U.S. PATENT DOCUMENTS

| | | | | |
|---|---|---|---|---|
| 2,279,990 | A * | 4/1942 | Hopkins | C23C 6/00 164/515 |
| 3,473,340 | A | 10/1969 | Ferrentino | |
| 4,652,176 | A | 3/1987 | Leonard | |
| 7,841,802 | B2 | 11/2010 | Fockersperger, Jr. | |
| 8,087,372 | B1 | 1/2012 | Ruffa | |
| 2009/0010716 | A1 | 1/2009 | Fockersperger, Jr. | |
| 2011/0133020 | A1* | 6/2011 | Fayret | B65H 75/4405 242/615.3 |
| 2015/0307317 | A1 | 10/2015 | Grimmond | |
| 2018/0155150 | A1* | 6/2018 | Belani | B64F 3/00 |

FOREIGN PATENT DOCUMENTS

| | | | |
|---|---|---|---|
| GB | 1049745 | A | 11/1966 |
| GB | 1157403 | A | 7/1969 |
| GB | 2510048 | A | 7/2014 |

(Continued)

*Primary Examiner* — William E Dondero

(74) *Attorney, Agent, or Firm* — Brinks Gilson & Lione

(57) ABSTRACT

An assembly and method for deploying, retrieving, and storing a cable having a minimum bend radius onto a drum. The assembly may comprise a frame, a rotatable drum carried by the frame, a levelwind carried by the frame, and a powertrain. The levelwind may comprise a rail spanning at least the width of the drum, and a traversable carriage carried by the rail. The levelwind may also comprise a cable guide carried by the carriage, where the cable guide comprises an elongated chute having contoured walls. The contoured walls of the chute include no bends having a radius less than the minimum bend radius of the cable. The powertrain may be operatively connected to rotate the drum about the drum axis and traverse the carriage along the rail. In some examples, the contoured walls of the chute are coated with a supplmentary coating.

19 Claims, 7 Drawing Sheets

(56) References Cited

FOREIGN PATENT DOCUMENTS

| | | | |
|---|---|---|---|
| GB | 2510048 | B | 5/2015 |
| GB | 2526580 | A | 12/2015 |
| GB | 2526580 | B | 4/2017 |
| GB | 2545925 | A | 7/2017 |
| WO | 2013/178792 | A1 | 12/2013 |
| WO | 2014/083341 | A2 | 6/2014 |
| WO | 2017/115070 | A1 | 7/2017 |

* cited by examiner

CABLE STORAGE AND HANDLING SYSTEMS AND METHODS

BACKGROUND

Cable storage and handling systems may be used for the deployment, retrieval, and storage of systems having long cables. For example, the OK-410 Handling and Storage Group is a system for the deployment, retrieval, and storage of a sonar array towable by a cable from a waterborne surface vessel. Such systems may include a rotatable drum and a levelwind to facilitate the deployment of a cable/array that is stored on the drum, and the retrieval of the deployed cable/array onto the drum for storage. The levelwind typically includes a rail spanning the width of the drum, and a carriage that is moveable along the rail. The cable/array is guided by a guiding assembly secured to the carriage during deployment or retrieval of the cable/array from or to the drum as the carriage traverses back and forth along the rail across the width of the drum. The design of the cable guiding assembly secured to the carriage is important to prevent damage to the cable/array during deployment and retrieval.

A typical design for the cable guiding assembly secured to the carriage in a levelwind includes a rigid frame supporting a number of cylindrical rollers that guide the cable/array along a prescribed path. Such a guiding assembly is often referred to as a roller box. One known problem with such a guiding assembly results from the rollers having a radius that is smaller than the minimum bend radius of the cable/array that often results in damage to the cable/array as it passes over the rollers by inducing micro-bending of the cable/array. The guiding assembly may also include a transition from the roller box to a bellmouth that may also be a source of damage to the cable/array.

Other possible designs for the guiding assembly include a sheave that supports the cable as it is guided through the carriage. A sheave, however, takes up a large amount of space which may often be limited in certain applications such as shipborne applications. Still other designs may include a rolling element fairlead. The rolling element fairlead may include a segmented chain supported by rollers that moves through an elliptical path, thereby fully supporting the cable along a partial arc with little friction. Though a rolling element fairlead may take up less space than a sheave, it employs many moving parts each of which may be a source of failure. Thus there is a need for an improved cable guiding assembly in the levelwind of such systems.

SUMMARY

In one aspect, the present disclosure is directed to an assembly for deploying, retrieving, and storing a cable having a minimum bend radius. The assembly may comprise comprising one or more rigid frames, a rotatable drum carried by a frame, a levelwind carried by a frame where the levelwind comprises a rail spanning at least the width of said drum, a traversable carriage carried by said rail, and a cable guide carried by said carriage. The cable guide may comprise an elongated chute having contoured surfaces defining a cavity extending through the chute wherein the contoured surfaces include no bends having a radius less than the minimum bend radius of the cable. The assembly may also include one or more power trains operatively connected to rotate said drum about the drum axis and traverse said carriage along said rail.

In another aspect, the contoured surfaces of the elongated chute of an assembly according to the present disclosure may include a supplementary coating comprising Monel or other suitable material such as electroless nickel, electroless nickel silicon carbide, or electroless nickel combined with hard chrome to reduce friction or provide corrosion resistance for the chute.

In another aspect of the present disclosure, a levelwind guide for use in a system for deploying, retrieving, and storing a cable having a minimum bend radius is disclosed wherein the guide may comprise an elongated chute having contoured surfaces defining a cavity extending through the chute wherein the contoured surfaces include no bends having a radius less than the minimum bend radius of the cable.

BRIEF DESCRIPTION OF THE DRAWINGS

The following will be apparent from elements of the figures, which are provided for illustrative purposes.

Figure 1:
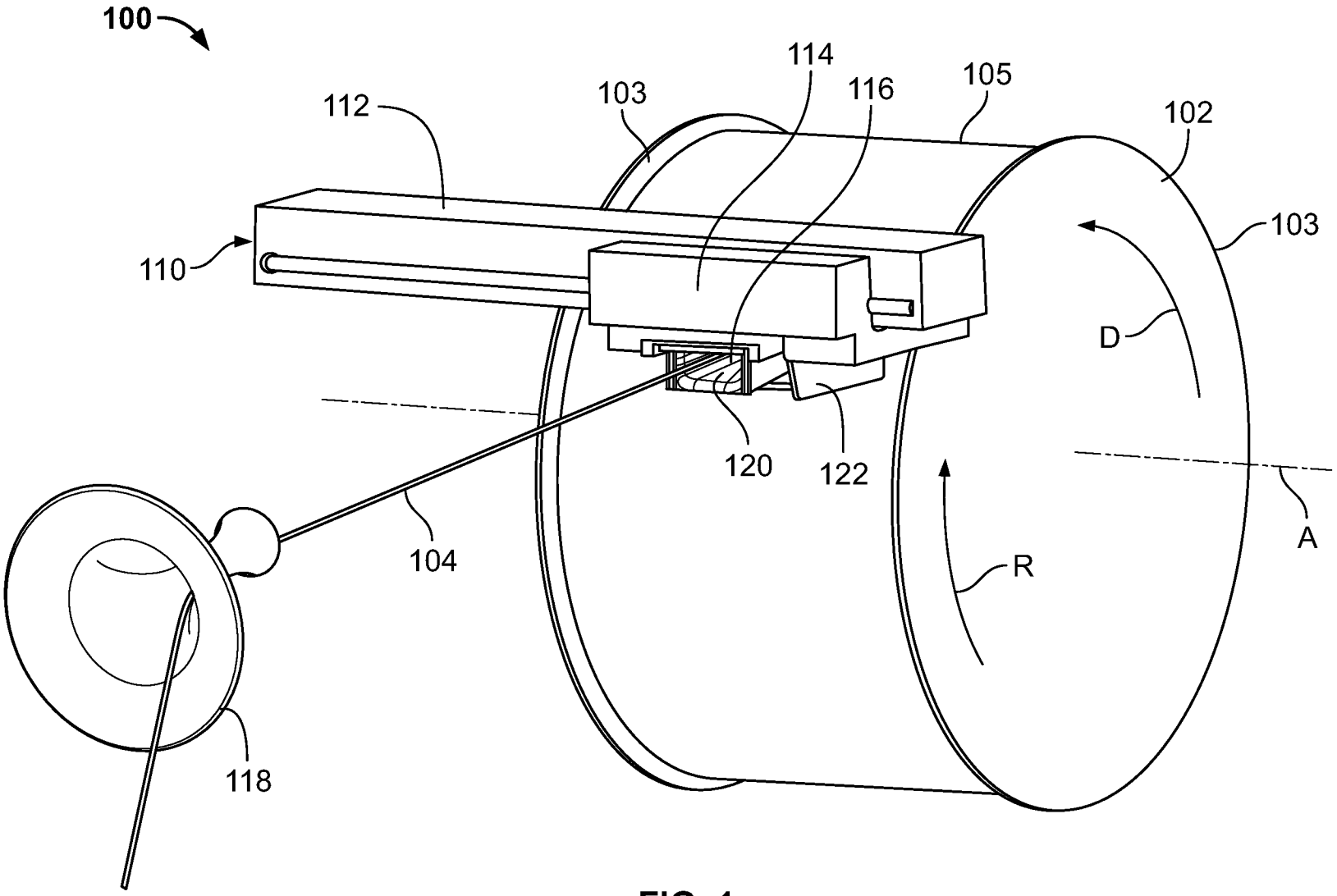
FIG. 1 is an illustration of a cable storage and handling system in accordance with some embodiments.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments in the drawings and specific language will be used to describe the same.

Figure 2:
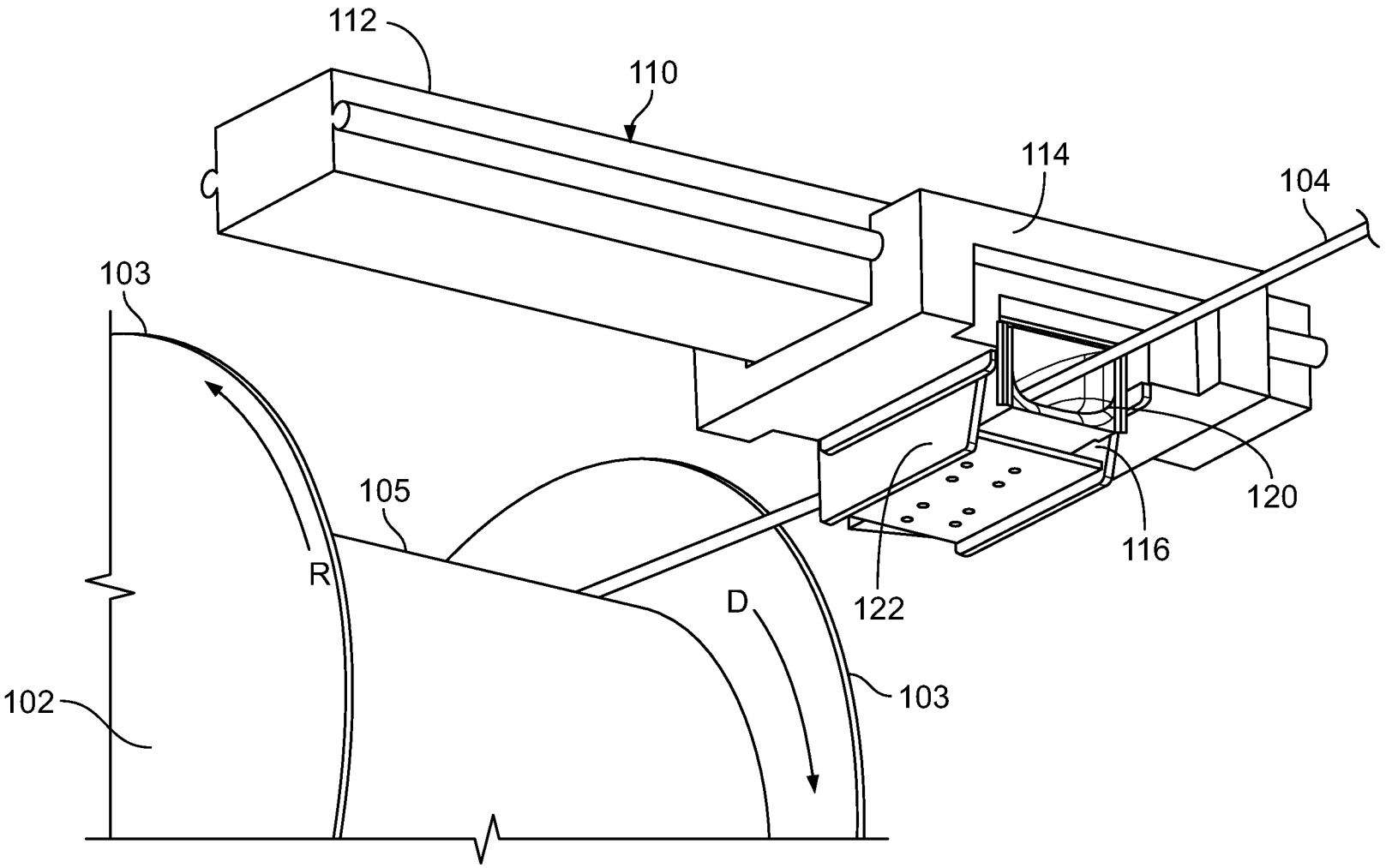
FIG. 2 is an illustration of a different view of the cable storage and handling system of FIG. 1 in accordance with some embodiments.
Figure 3:
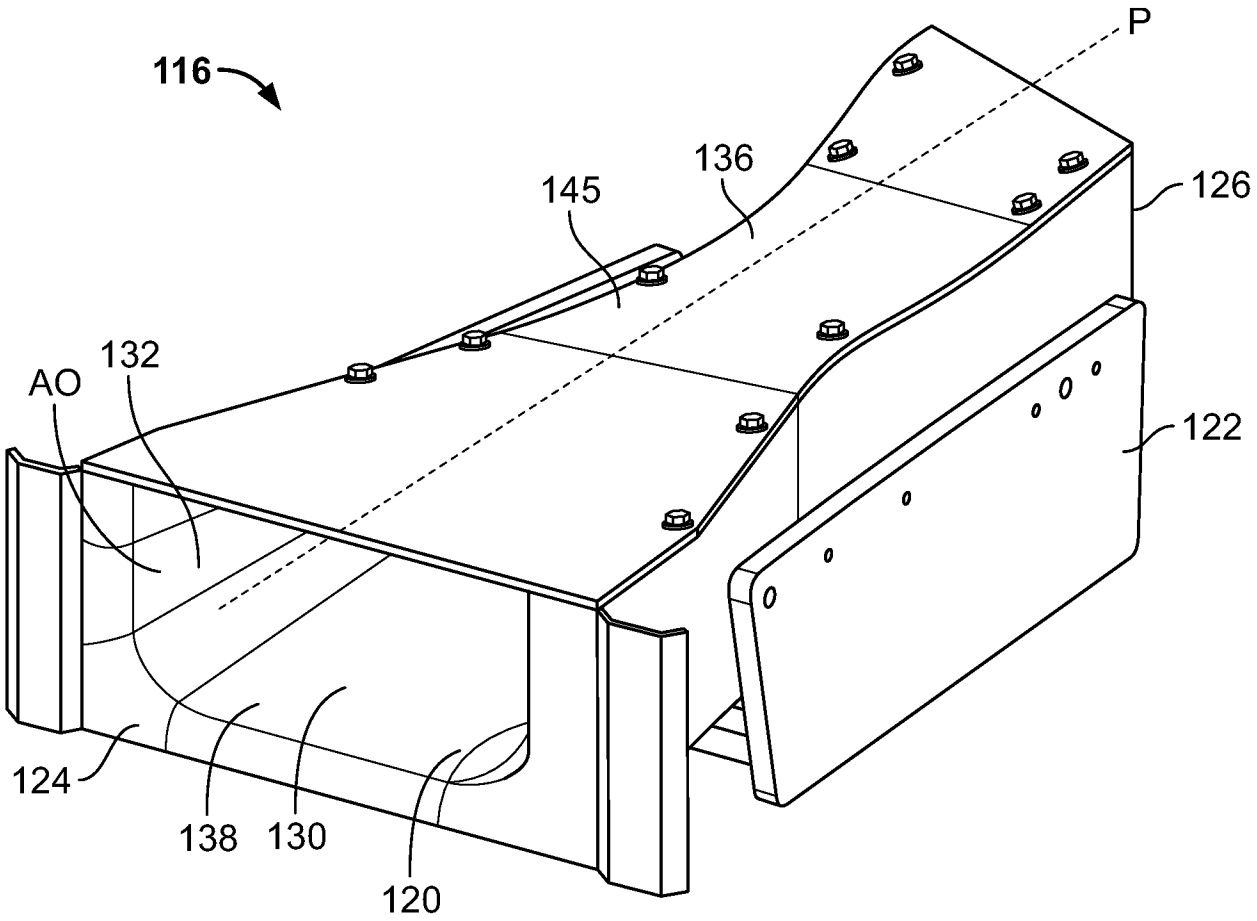
FIG. 3 is an illustration of cable guiding assembly in accordance with some embodiments.
Figure 4:
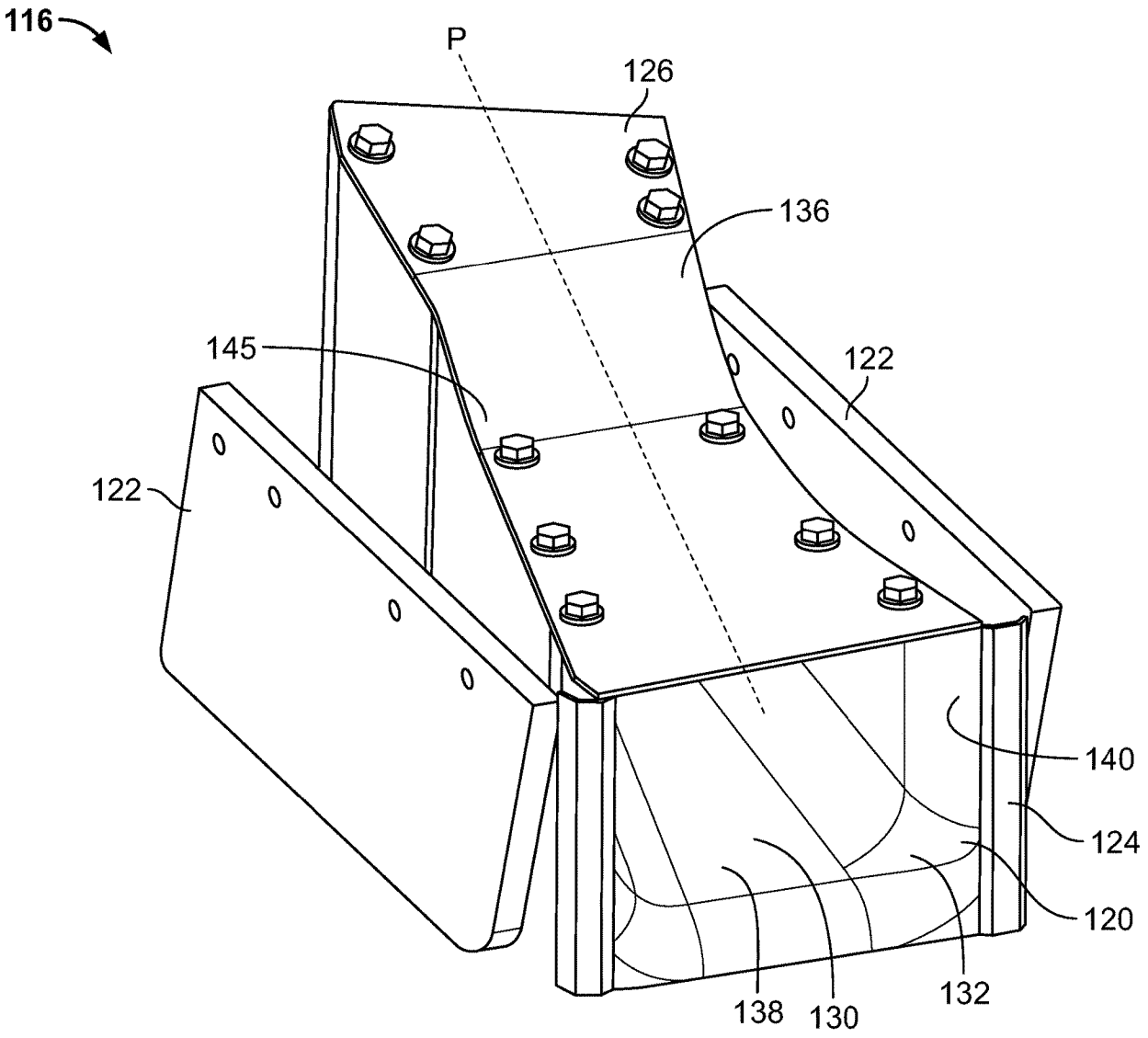
FIG. 4 is an illustration of a different view of the cable guiding assembly of FIG. 3 in accordance with some embodiments.
Figure 5:
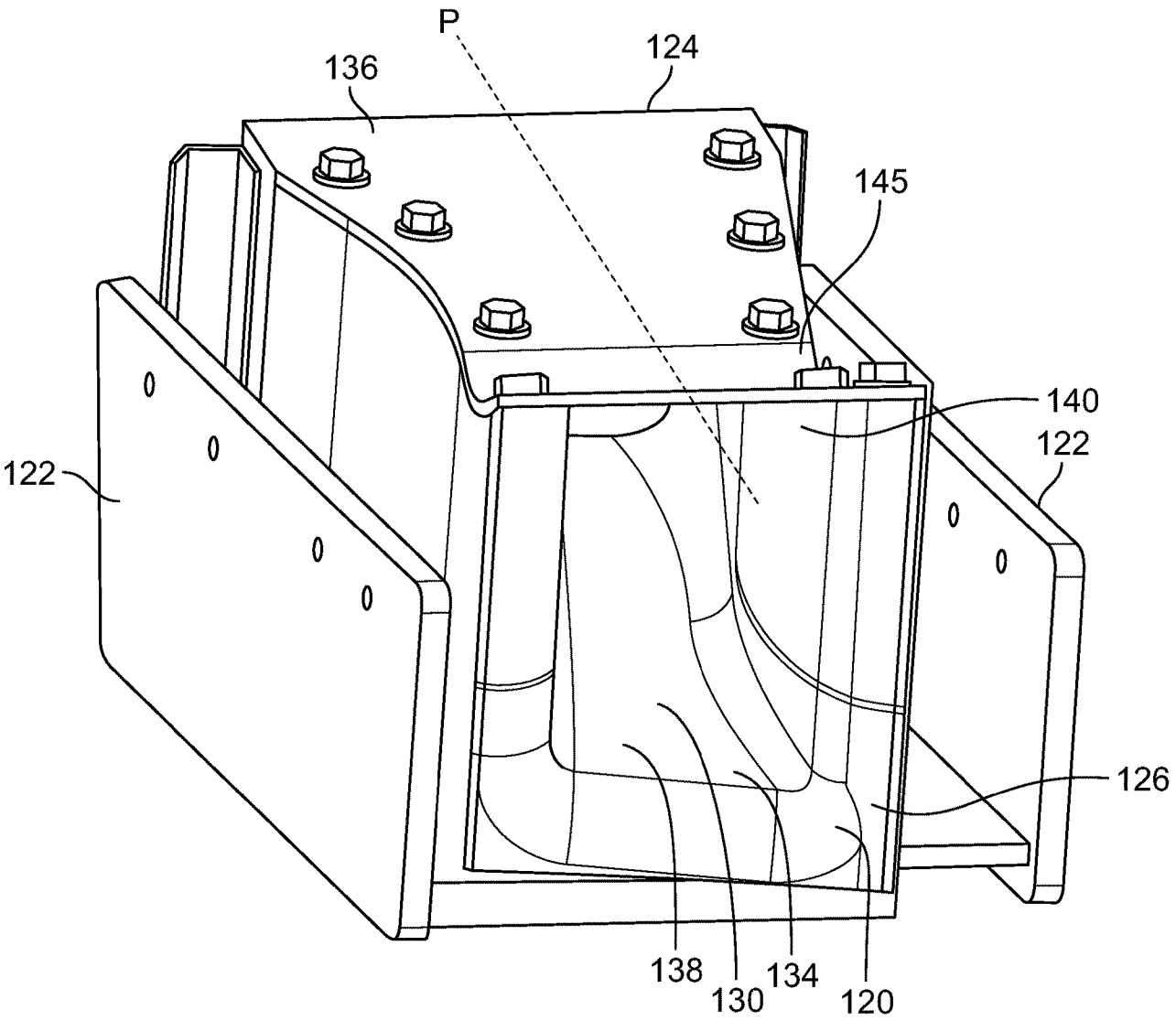
FIG. 5 is an illustration of a different view of the cable guiding assembly of FIGS. 3 and 4 in accordance with some embodiments.
Figure 6:
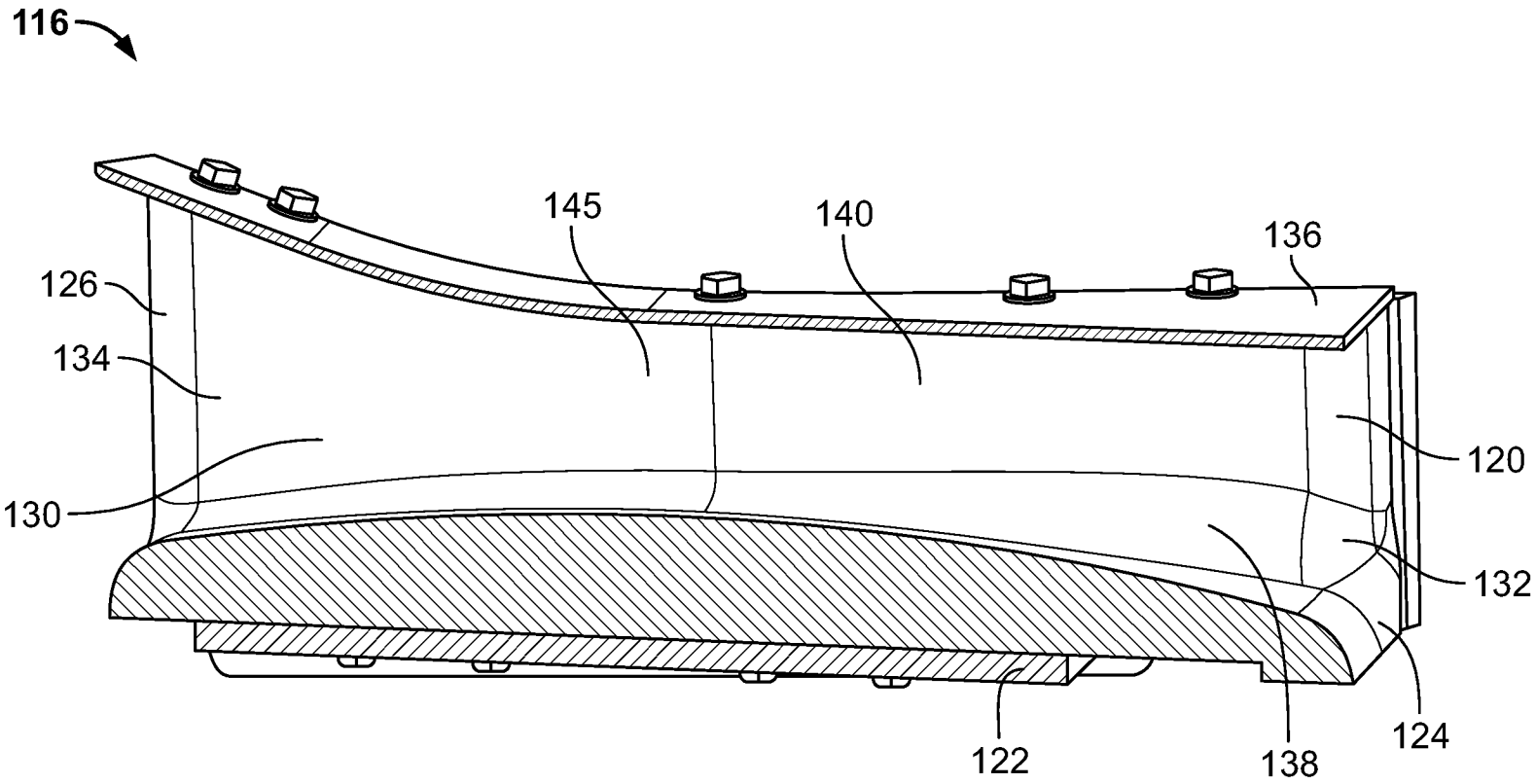
FIG. 6 is an illustration of a cut-away view from a side of the cable guiding assembly of FIGS. 3-5 in accordance with some embodiments.

FIGS. 1 and 2 illustrate an exemplary cable storage and handling system 100 according to the present disclosure. The system 100 comprises a drum 102 (i.e., a spool) that is rotatable about an axis A. In this exemplary system the drum 102 is rotatable about the axis A which is oriented horizontally. The drum 102 includes a cylindrical portion 105 for storing a cable between lateral flanges 103. The drum 102 may be driven to rotate about axis A by any suitable conventional power train (not shown).

The system 100 includes a levelwind assembly 110 for facilitating the deployment and retrieval of a cable 104 to and from the drum 102. The levelwind assembly 110 comprises a rail 112 oriented on an axis parallel to axis A and spanning at least the horizontal dimension (i.e., width) of the cylindrical portion 105 of the drum 102. A carriage 114 is carried by the rail 112 and is operable to traverse along the rail 112. A cable guiding assembly 116 is carried by the carriage 114 for guiding the cable 104 as it passes through the cable guiding assembly 116 during deployment/retrieval of the cable 104 as illustrated in FIG. 2.

The system 100 may be supported by one or more rigid frames (not shown). In this exemplary system, the cable storage and handling system 100 also comprises a fairlead 118 for guiding the cable 104 to and from the system such as to and from overboard on a waterborne surface vessel.

During operation of the cable storage and handling system 100, the power train may be operatively connected to rotate the drum 102 about the axis A. The power train (or a separate power train) may also be operatively connected to cause the carriage 114 to traverse along the rail 112 while the drum 102 is rotating. The translation of the carriage 114 across the width of the drum 102 facilitates the loading/unloading of the cable 104 to/from the drum 102.

For example, during the retrieval of a deployed cable 104, the drum 102 may be driven by the power train to rotate in a first direction as illustrated by arrow R. As the drum 102 rotates, a power train causes the carriage 114 to traverse along the rail 112 to facilitate the smooth loading of the cable 104 onto to drum 102. Similarly, during the deployment of the cable 104, the drum 102 may be driven by the power train to rotate in a second direction as illustrated by arrow D. As the drum 102 rotates, a power train causes the carriage 114 to traverse along the rail 112 to facilitate the smooth unloading of the cable 104 from the drum 102.

In some examples, the rail 112 spans at least the width of the cylindrical portion 105 of the drum 102 bounded by the lateral flanges 103 that stores the cable 104. In some examples, the carriage 114 laterally traverses the rail 112 to facilitate the loading/unloading of the cable to/from the full width of the cylindrical portion 105. In some examples, the power train causes the carriage 114 to traverse the rail 112 at a velocity such that, as the cable 104 is wound onto the drum 102, during the same traversal of rail 112, cable 104 covers the entire width of cylindrical portion 105 of the drum 102. In another example, the power train may cause the carriage 114 to traverse the rail 112 at a velocity such that a first portion of the cable 104 is wound onto the drum 102 to lay adjacent to and contact a second portion of the cable 104.

In some examples, the cable 104 traverses through a fixed overboarding fairlead 118, through which the cable 104 is deployed or retrieved. For example, the overboarding fairlead 118 may be mounted at the stern of a waterborne surface vessel to guide the cable 104 overboard from the vessel.

A key component in the levelwind assembly 110 for facilitating the efficient loading/unloading of the cable 104 to/from the drum 102 while minimizing any damage to the cable is the cable guiding assembly 116. The cable guiding assembly 116 comprises a chute 120 for guiding the cable 104 as it traverses through a cavity defined by the chute 120, and a support assembly 122 for securing the cable guiding assembly 116 to the carriage 114 enabling the cable guiding assembly 116 to traverse along the rail 112 with the carriage 114.

FIGS. 3-6 illustrate different views of a cable guiding assembly 116 according to an embodiment of the present disclosure. With reference to FIGS. 3-6, the cable guiding assembly 116 comprises a chute 120 and a support assembly 122. The cable guiding assembly 116 is secured to the carriage 114 in an orientation such that a first end 124 faces away from the drum 102 and a second end 126 faces toward the drum 102. In an embodiment where the cable storage and handling system 100 is deployed on a waterborne surface vessel, the first end 124 would be the aft end of the cable guiding assembly 116, and the second end 126 would be the forward end of the assembly 116 relative to the vessel.

The chute 120 defines a cavity 130 comprising a first opening 132 at the first (e.g., aft) end 124 of the assembly 116, a second opening 134 at the second (e.g., forward) end 126 of the assembly 116, and contoured surfaces extending between the first and second openings 132, 134. In the context of the present disclosure, the term "contoured surface" means a surface having a curvature that may be constant or varying.

The contoured surfaces may comprise a contoured ceiling 136 defining an upper boundary of the cavity 130, a contoured floor 138 defining a lower boundary of the cavity 130, and opposing walls 140 defining the lateral boundaries of the cavity 130. In the exemplary embodiment, the floor 138 and sides 140 are manufactured as a single piece, however, the walls and floor may be separate pieces joined by any conventional means such as bolted connections. In the exemplary embodiment, the ceiling 136 is joined to the walls 140 by bolted connections, however, in some embodiments, the ceiling may be manufactured as a single piece with the walls or with the walls and floor.

In this example, the contoured surfaces include no bends having a radius less than a minimum bend radius of the cable/array that will be guided by the chute. The materials used to construct the chute may be selected to balance the desirability of strength, low friction, high thermal conductivity, and corrosion resistance. In some embodiments, the chute 120 is formed from a metal such as steel which allows the chute 120 to be strong enough to handle required loads and to provide thermal conductivity to dissipate heat that may be generated as a cable traverses through the chute. The surfaces may be treated with a supplementary coating such as Monel, electroless nickel, electroless nickel silicon carbide, electroless nickel combined with hard chrome, or any other suitable coating in order to provide the desired supplementary properties to the base material such as low friction. The coating may also provide corrosion resistance for the chute 120 which may be particularly desirable in a seawater environment.

Cable guiding assembly 100 may guide a cable (not shown) through cavity 130 of chute 120 as it is wound (retrieved), or unwound (deployed), from a drum (also not shown). For example, when the cable is wound, the cable may enter cavity 130 through a first (e.g. aft) opening 132, proceed through cavity 130, and exit cavity 130 through second (e.g. forward) opening 134 onto the drum. If, for example, the cable is being unwound, the cable may enter cavity 130 through second opening 134, proceed through cavity 130, and exit cavity 130 through first opening 132.

In this embodiment, the openings 132, 134 include a larger cross-sectional area than the intermediate portion 130 of the chute 120 to accommodate the varying angles of the cable relative to the chute to avoid damaging the cable by subjecting the cable to bends that are smaller than a minimum bend radius of the cable. In this embodiment, the contours of the surfaces also include no bends having a radius smaller than a minimum bend radius of the cable.

In some examples, the chute 120 is elongated such that a distance from first opening 132 to second opening 134 is longer than either a maximum width or height of the chute. In some examples, the width of an intermediate section 145 is less than the width the openings 132, 134. In some examples, the height of intermediate section 145 is less than the height of openings 132, 134.

The openings 132, 134 of the chute 130 may also be laterally offset from an axis P perpendicular to the axis A of rotation of the drum. In this example, the second (e.g., forward) opening 134 is offset laterally to the right of the axis P relative to the first (e.g., aft) opening 132. The lateral offset effects contact of the cable with a selected boundary of the second (e.g. forward) opening 134 during loading and unloading of the cable to/from the drum. In this example, the cable will maintain contact with the left wall of the chute forming the left boundary of the opening 134.

Figure 7:
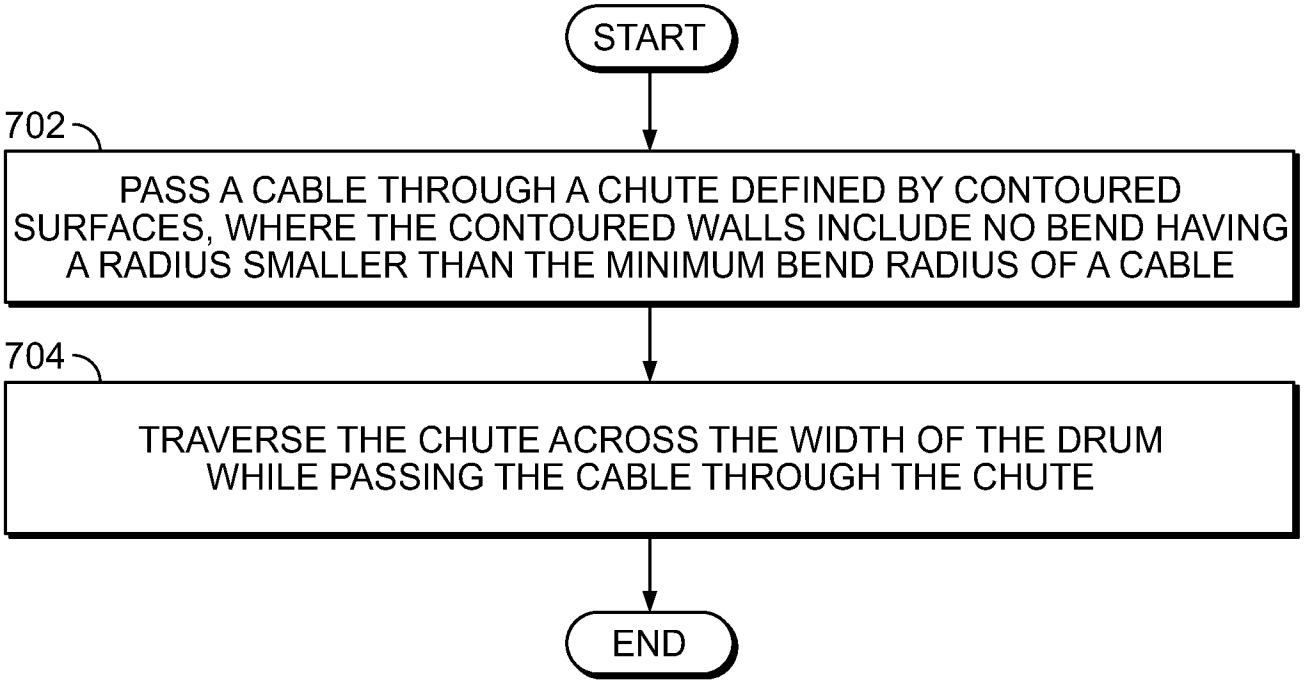
FIG. 7 is flowchart of an example method that can be carried out by the system illustrated in FIG. 1 in accordance with some embodiments.

FIG. 7 is a flowchart of an example method 700 that can be carried out by the cable storage and handling system 100. Method 700 may allow for the guiding of a cable having a minimum bend radius onto a drum and preventing the cable from bending more than the minimum bend radius of the cable. The method begins at step 702, where the cable is passed through a chute having contoured surfaces defining a cavity, where the contoured surfaces include no bends having a radius smaller than the minimum bend radius of the cable. At step 704, the chute is traversed across the width of the drum while passing the cable through the chute. The method then ends.

Although the method is described with reference to an illustrated flowchart, it will be appreciated that many other ways of performing the acts associated with the method may be used. For example, the order of some operations may be changed, and some of the operations described may be optional.

Among other advantages, the apparatus and methods described herein may allow for the deployment and retrieval of a cable in a levelwind system with a reduction to cable damage, such as a reduction to cable damage due to micro-bending of the cable. Persons of ordinary skill in the art having the benefit of the disclosures herein would recognize these and other benefits as well.

Although examples are illustrated and described herein, embodiments are nevertheless not limited to the details shown, since various modifications and structural changes may be made therein by those of ordinary skill in the art within the scope and range of equivalents of the claims.

What is claimed is:

1. A levelwind cable guide for guiding a cable having a minimum bend radius onto a drum, said cable guide comprising an elongated chute having contoured surfaces defining a cavity extending through a length of the chute, wherein the contoured surfaces include no bend having a radius smaller than the minimum bend radius of the cable, wherein the contoured surfaces comprise a contoured ceiling defining an upper boundary of the cavity, a contoured floor defining a lower boundary of the cavity, and opposing lateral walls defining lateral boundaries of the cavity.

2. The cable guide of claim 1 wherein at least a portion of the contoured surfaces of said chute are coated with a supplementary coating.

3. The cable guide of claim 2 wherein the coating comprises Monel.

4. The cable guide of claim 1 wherein said chute includes an intermediate section defining a portion of the cavity having a minimum cross-sectional area.

5. The cable guide of claim 4 wherein a cross-sectional area of the cavity defined by said chute decreases from an opening at each end of the chute to the portion of the cavity having the minimum cross-sectional area.

6. The cable guide of claim 5 wherein said chute comprises a ceiling attached to a channel portion having a floor and opposing lateral walls.

7. The cable guide of claim 1 having a longitudinal axis intersecting an opening at each end of the chute, wherein the opening at one end of the chute is laterally and elevationally offset from the axis relative to the opening at the other end of the chute.

8. An assembly for deploying, retrieving, and storing a cable having a minimum bend radius, said assembly comprising:

a rotatable drum, the drum rotatable about an axis of the drum;

a levelwind, said levelwind comprising:

a rail spanning at least a width of said drum;

a traversable carriage carried by said rail, the carriage configured to traverse along the rail; and a cable guide carried by said carriage, said cable guide comprising an elongated chute having contoured surfaces defining a cavity extending through the chute wherein said contoured surfaces include no bends having a radius less than the minimum bend radius of the cable, wherein the contoured surfaces comprise a contoured ceiling defining an upper boundary of the cavity, a contoured floor defining a lower boundary of the cavity, and opposing lateral walls defining lateral boundaries of the cavity.

9. The assembly of claim 8 wherein at least a portion of said contoured surfaces of said chute are coated with a supplementary coating.

10. The assembly of claim 9 wherein the coating comprises one or more of Monel, electroless nickel, electroless nickel silicon carbide, or electroless nickel combined with hard chrome.

11. The assembly of claim 8 wherein said chute includes an intermediate section defining a portion of the cavity having a minimum cross-sectional area.

12. The assembly of claim 11 wherein a cross-sectional area of the cavity defined by said chute decreases from an opening at each end of the chute to the portion of the cavity having the minimum cross-sectional area.

13. The assembly of claim 8 wherein the contoured ceiling is attached to a channel portion, the floor and the opposing lateral walls included in the channel portion.

14. The assembly of claim 8 wherein said chute includes an axis perpendicular to an axis of rotation of said drum, wherein an opening at one end of the chute is laterally offset from the axis relative to an opening at the other end of the chute.

15. The assembly of claim 14 wherein an opening at one end of the chute is elevationally offset from the axis relative to an opening at the other end of the chute.

16. The assembly of claim 8 wherein said chute includes an axis perpendicular to an axis of rotation of said drum, wherein an opening at one end of the chute is elevationally offset from the axis relative to an opening at the other end of the chute.

17. The assembly of claim 8 wherein the floor and the opposing lateral walls are manufactured as a single piece.

18. The assembly of claim 8 wherein the cable guide is secured to an underside of the carriage by a support assembly, the support assembly extending from the carriage down a lateral side of the cable guide, underneath the cable guide, and back up an opposing lateral side of the cable guide to the carriage.

19. A method of guiding a cable having a minimum bend radius onto a drum, the method comprising:

rotating the drum;

passing the cable through a chute defined by contoured surfaces, a cavity extending through the chute, wherein the contoured surfaces include no bend having a radius smaller than the minimum bend radius of the cable, wherein the contoured surfaces comprise a contoured ceiling defining an upper boundary of the cavity, a contoured floor defining a lower boundary of the cavity, and opposing walls defining lateral boundaries of the cavity; and traversing the chute across a width of the drum while passing the cable through the chute.

* * * * *